US008511527B2

(12) United States Patent
Ho et al.

(10) Patent No.: US 8,511,527 B2
(45) Date of Patent: Aug. 20, 2013

(54) DUAL SAFETY COMBUSTION POWERED TOOL DEVICE

(75) Inventors: Jung-Mao Ho, Taichung (TW); Chang-Sheng Lin, Taichung (TW); Sheng-Man Wang, Taichung (TW)

(73) Assignee: Basso Industry Corp., Taichung (TW)

( * ) Notice: Subject to any disclaimer, the term of this patent is extended or adjusted under 35 U.S.C. 154(b) by 241 days.

(21) Appl. No.: 13/206,394

(22) Filed: Aug. 9, 2011

(65) Prior Publication Data

US 2012/0037682 A1 Feb. 16, 2012

(30) Foreign Application Priority Data

Aug. 10, 2010 (TW) ..... 99126628 A

(51) Int. Cl.
*B21J 15/28* (2006.01)
*B27F 7/17* (2006.01)

(52) U.S. Cl.
USPC ..... 227/8

(58) Field of Classification Search
USPC ..... 173/170; 227/2–8
See application file for complete search history.

(56) References Cited

U.S. PATENT DOCUMENTS

| | | | | |
|---|---|---|---|---|
| 5,197,646 | A | 3/1993 | Nikolich | |
| 7,464,843 | B2 * | 12/2008 | Huang | 227/8 |
| 7,810,688 | B2 * | 10/2010 | Wu et al. | 227/8 |
| 8,167,183 | B2 * | 5/2012 | Matsunaga et al. | 227/8 |
| 2007/0278275 | A1 * | 12/2007 | Ho et al. | 227/8 |
| 2010/0116863 | A1 * | 5/2010 | Suda | 227/8 |
| 2011/0057014 | A1 * | 3/2011 | Yang et al. | 227/8 |
| 2011/0062207 | A1 * | 3/2011 | Hlinka et al. | 227/8 |
| 2011/0132959 | A1 * | 6/2011 | Hlinka et al. | 227/8 |
| 2011/0240709 | A1 * | 10/2011 | Oouchi | 227/8 |

* cited by examiner

*Primary Examiner* — Robert Long
(74) *Attorney, Agent, or Firm* — Holland & Hart LLP

(57) ABSTRACT

A dual safety combustion powered tool device includes a push member disposed to be pressed against a targeted surface to bring a lever to turn to be closer to an actuating unit. A trigger body is pulled to move the actuating unit so as to permit an actuating region to abut against the lever and to turn the actuating unit to an orientation where an actuating region is engageable with an ignition switch. Subsequently, a further movement of the trigger body to a final-stage position permits the actuating region to switch on the ignition switch so as to ignite combustion for initiation of a stroke movement of a driver blade. With such construction, undesired firing of the combustion powered tool device can be avoided.

7 Claims, 16 Drawing Sheets

DUAL SAFETY COMBUSTION POWERED TOOL DEVICE

CROSS-REFERENCE TO RELATED APPLICATION

This application claims priority of Taiwanese Patent Application No. 099126628, filed on Aug. 10, 2010, the disclosure of which is herein incorporated by reference.

BACKGROUND OF THE INVENTION

1. Field of the Invention

This invention relates to a combustion powered tool device, more particularly to a dual safety combustion powered tool device.

2. Description of the Related Art

Referring to FIGS. 1 and 2, a combustion powered tool device 1 disclosed in U.S. Pat. No. 5,197,646 is shown to include a main housing 11 for accommodating a piston-driver blade assembly 16 which strikes a nail fed from a magazine out of a nose end 17 against a targeted surface when making a stroke movement caused by actuation of a trigger body 13. A lock-out pawl 14 has an end pivotally connected to the trigger body 13, and an opposite end. The opposite end is displaced in an aperture 151 of a valve sleeve member 152 when the valve sleeve member 152 is moved to a rearward combustion-chamber closed position, as a result of the engagement of a push member 15 with the targeted surface. At this stage, as shown in FIG. 2, the trigger body 13 is permitted to be moved to an actuating position. When the push member 15 is no longer pressed by the targeted surface and the valve sleeve member 152 is thereby displaced to a forward combustion-chamber opened position, as shown in FIG. 1, the pawl 14 is engaged with an external wall of the valve sleeve member 152, so that the trigger body 13 cannot be moved to the actuating position, thereby preventing undesirable firing of the combustion powered tool device 1.

However, during operation, if the push member 15 is not properly engaged with the targeted surface when the trigger body 13 is moved only halfway to the actuating position, and if the pawl 14 is displaced to engage the aperture 151 to permit the trigger body 13 to freely move, inadvertent continued triggering action by the user toward the actuating position might give rise to an undesirable firing.

SUMMARY OF THE INVENTION

An object of the present invention is to provide a dual safety combustion powered tool device which can prevent undesirable firing thereof.

According to this invention, the dual safety combustion powered tool device includes a housing body defining a main chamber, a handgrip body defining a subchamber adjacent to the main chamber, an ignition switch mounted in and movable relative to the subchamber between a switch-off position and a switch-on position, and a trigger body disposed to be movable among an untriggered position, an initial-stage position, and a final-stage position. An actuating unit is disposed to move with the trigger body, and has a pivot area that defines a pivot axis, an actuated region, and an actuating region opposite to the actuated region relative to the pivot area. The actuating unit is turnable about the pivot axis between a first orientation in which the actuating region is guarded against movement with the trigger body toward the final-stage position so as to leave the ignition switch to remain in the switch-off position, and a second orientation in which the actuating region is engageable with the ignition switch when moving with the trigger body to the final-stage position, thereby displacing the ignition switch to the switch-on position. A first biasing member is disposed to bias the actuating unit toward the first orientation. A push member is disposed forwardly of and movable to a nose end of the housing body to a pressed position as a result of being pressed against a targeted surface. A lever is disposed in the main chamber to be turnable about a fulcrum axis, and has a power end and a weight end which confronts the actuated region, and which is movable between a non-shifted position, where the weight end is remote from the actuated region, and a shifted position, where the weight end is closer to the actuated region. A second biasing member is disposed to bias the weight end toward the non-shifted position. An actuator is disposed forwardly from the power end, and is coupled to move with the push member such that, when the push member is displaced to the pressed position, the actuator is brought to push the power end so as to move the weight end to the shifted position, and such that, when the actuating unit is moved with the trigger body to the final-stage position, the actuated region is brought to abut against the weight end to displace the actuating unit to the second orientation. Therefore, a stroke movement of a driver blade initiated by the ignition switch can not be made without carrying out the steps of pressing the push member against a targeted surface to the pressed position, and pulling the trigger body to the final-stage position in a consecutive manner.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
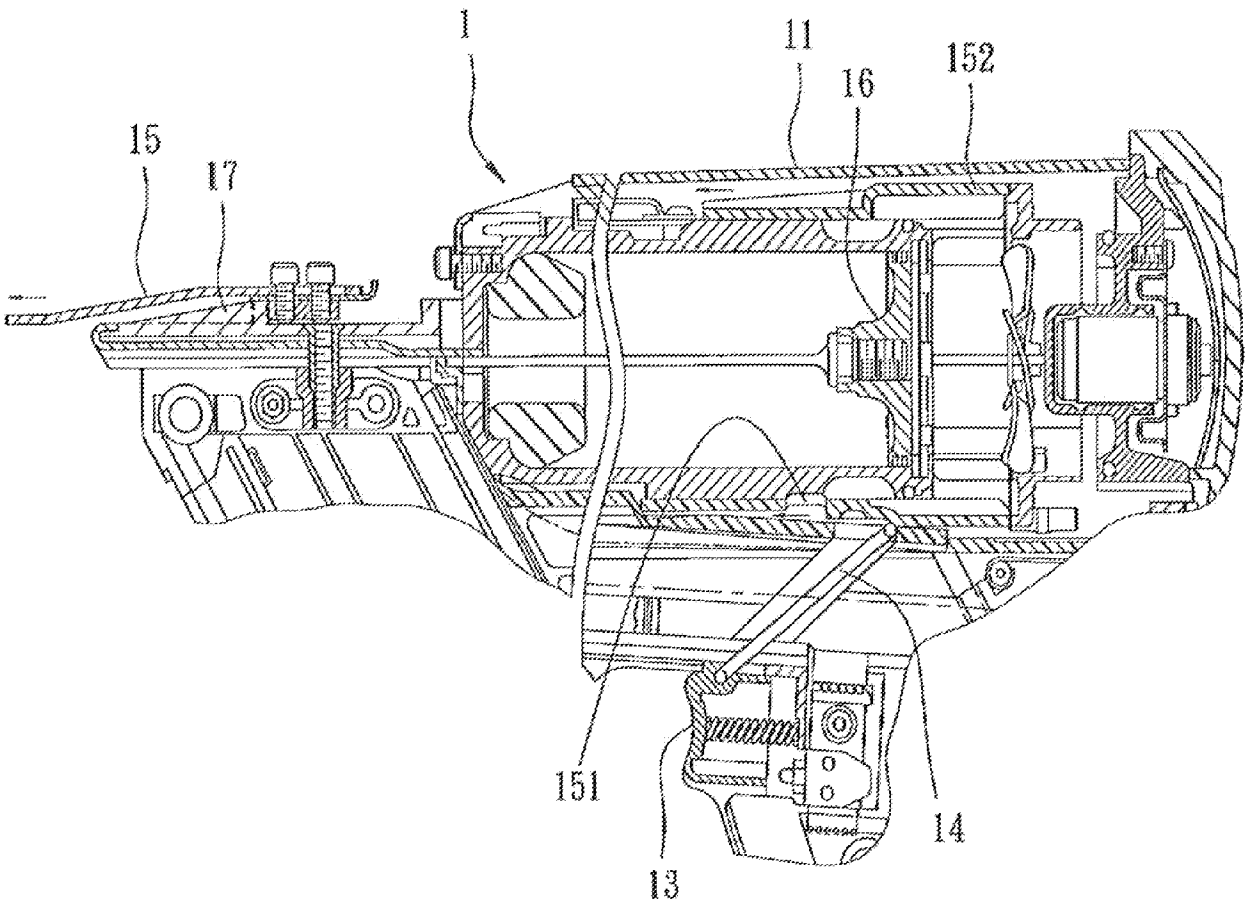
FIG. 1 PRIOR ART
FIG. 1 is a fragmentary sectional view of a conventional safety combustion powered tool device in a normal state.
Figure 2:
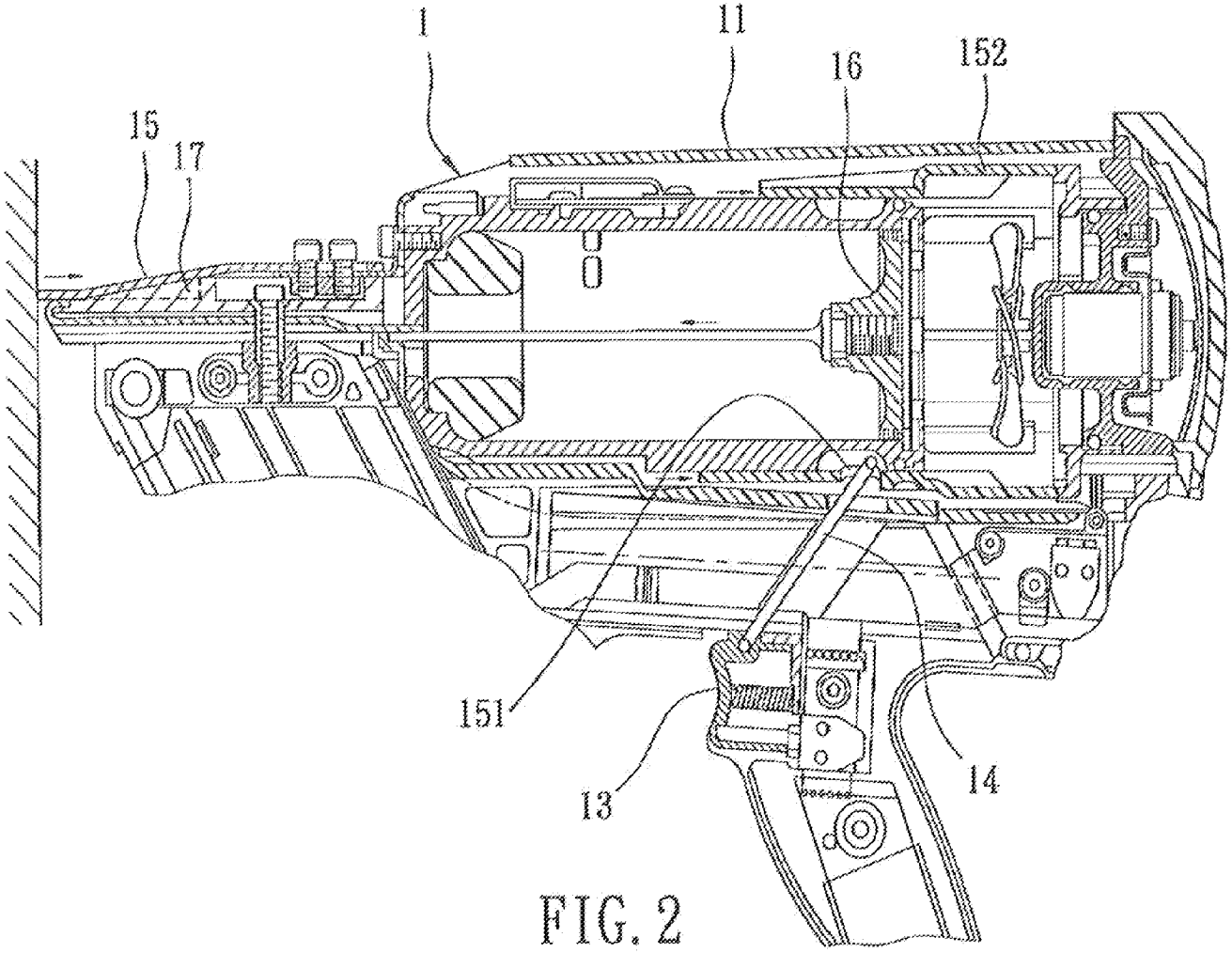
FIG. 2 PRIOR ART
FIG. 2 is a fragmentary, sectional view of the conventional safety combustion powered tool device with a press member pressed against a targeted surface.

Before the present invention is described in greater detail, it should be noted that same reference numerals have been used to denote like elements throughout the specification.

Figure 3:
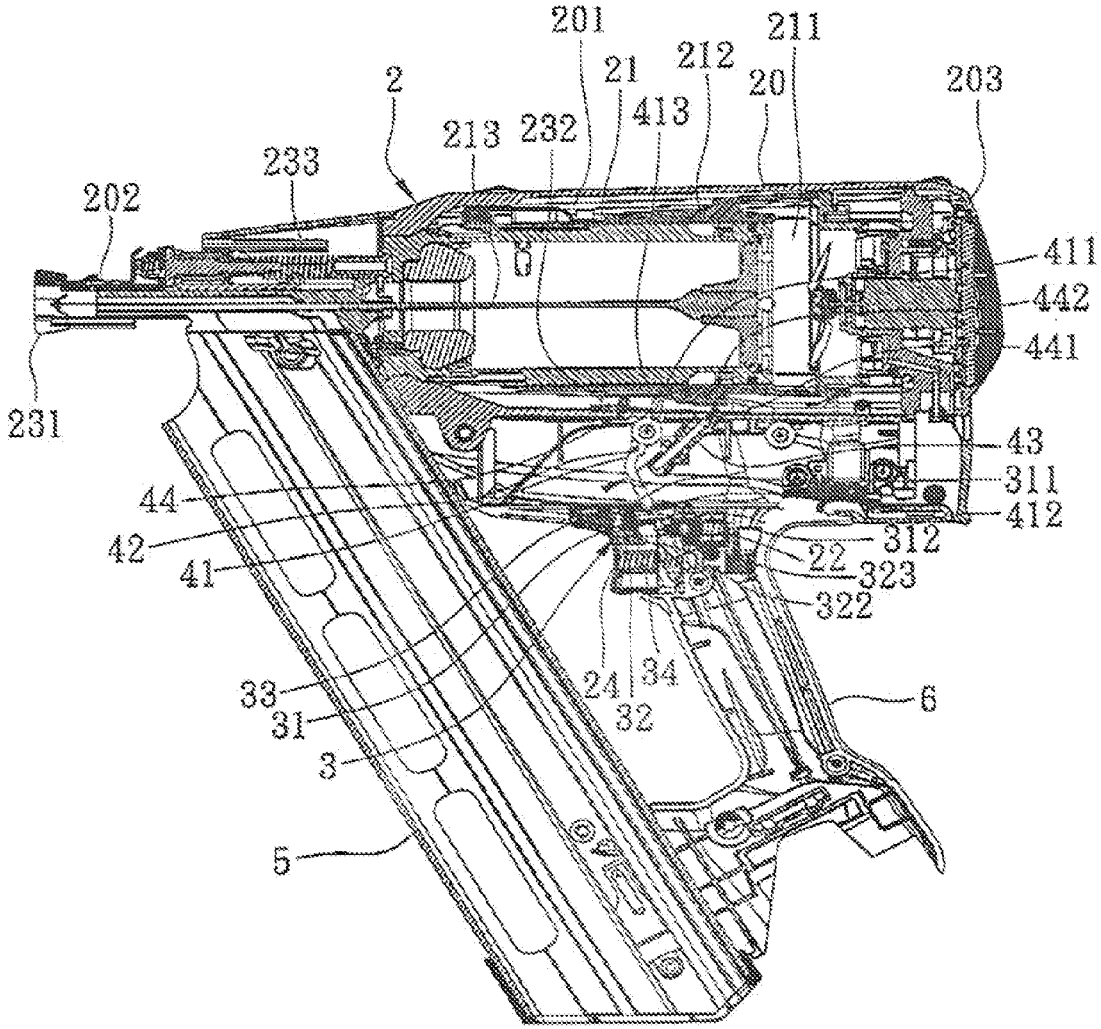
FIG. 3 is a sectional view of the first embodiment of a dual safety combustion powered tool device according to this invention.
Figure 4:
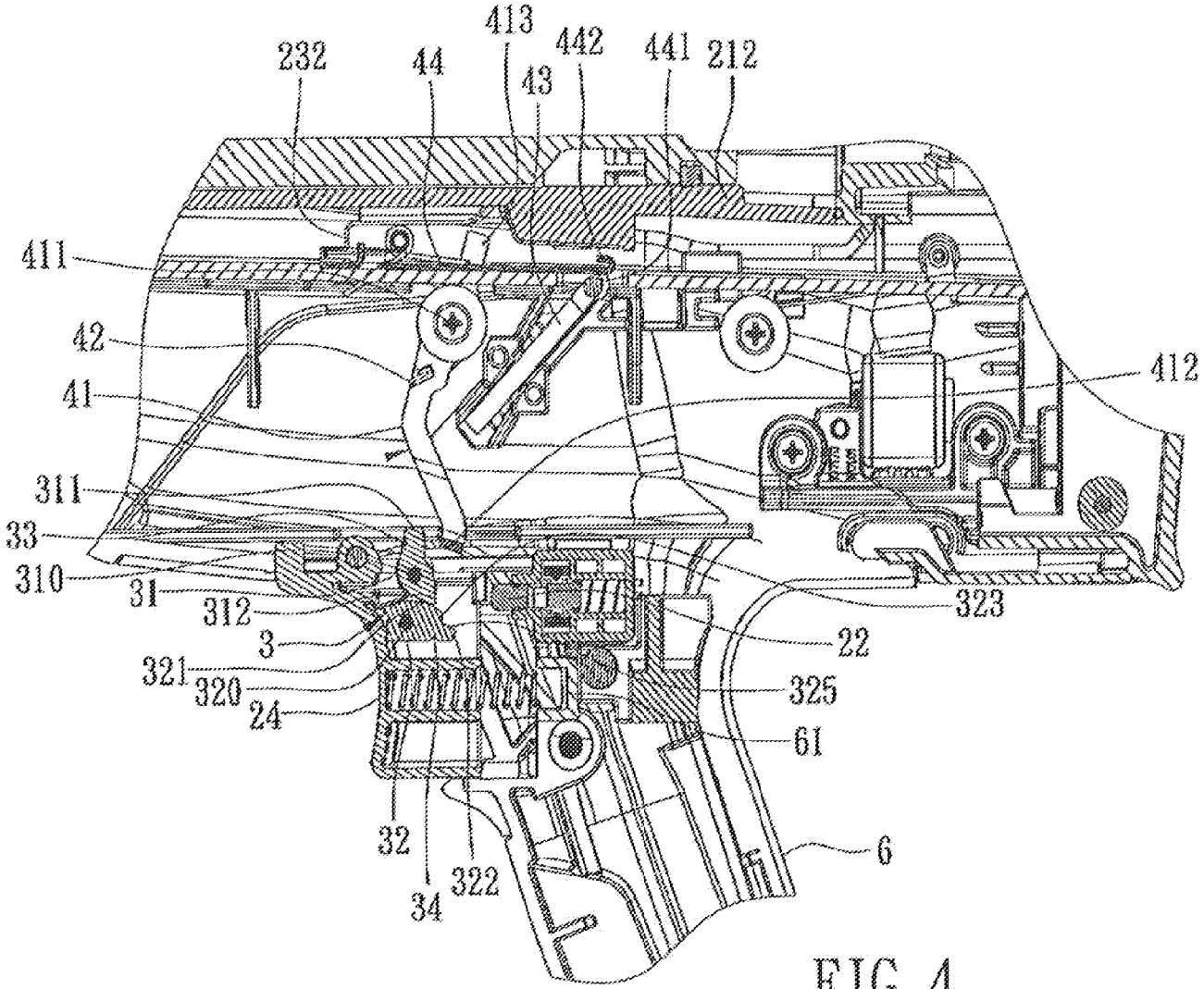
FIG. 4 is a fragmentary, sectional view of the first embodiment when a lever is in a non-shifted position.

Referring to FIGS. 3 and 4, the first embodiment of a dual safety combustion powered tool device 2 according to the present invention is shown to comprise a housing body 20 which defines a main chamber 201 which extends in a longitudinal direction to terminate at nose and head ends 202, 203. A cylinder 21 is disposed in the main chamber 201, and a piston-driver blade assembly 213 is disposed in the cylinder 21 to make a stroke movement so as to strike a nail fed from a magazine 5 out of the nose end 202 against a targeted surface. A valve sleeve 212 is mounted on and movable relative to the cylinder 21 so as to open and close a combustion chamber 211. A push member 231 is disposed forwardly of and movable to the nose end 202 between a normal position, where the push member 231 is remote from the head end 203, and a pressed position, where the push member 231 is closer to the head end 203 as a result of being pressed against the targeted surface. A biasing member 233 is disposed to bias the push member 231 to the normal position. The valve sleeve 212 is connected to the push member 231 so as to move therewith. An actuator 232 is coupled to move with the push member 231 and extends radially from the valve sleeve 212.

A handgrip body 6 defines a subchamber 61 adjacent to the main chamber 201. An ignition switch 22 is mounted in and movable relative to the subchamber 61 between a switch-off position and a switch-on position where the ignition switch 22 is switched on to ignite a combustion in the combustion chamber 211 for initiation of the stroke movement of the piston-driver blade assembly 213. A trigger body 24 is disposed to be movable among an untriggered position, an initial-stage position, and a final-stage position.

An actuating unit 3 is disposed to move with the trigger body 24. In this embodiment, the actuating unit 3 includes a pivot body 31, a cam body 32, a first biasing member 33, and a third biasing member 34. The pivot body 31 has a pivot area pivotally mounted in the subchamber 61 about a pivot axis 310, an actuated region 311, and a coupling region 312. The cam body 32 is pivotally mounted in the subchamber 61 about a cam axis 320 parallel to the pivot axis 310, and which has a cam surface 325 about the cam axis 320 to serve as an actuating region 322 and a non-actuating region 323. The actuating region 322 is distant from the cam axis 320 by a length that is longer than a length by that the non-actuating region 323 is distant from the cam axis 320. The cam surface 325 of the cam body 32 further has a coupled region 321 which is engaged with the coupling region 312 of the pivot body 31 so as to be angularly displaced about the cam axis 320 as a result of turning the pivot body 31 about the pivot axis 310. In particular, when the pivot body 31 is turned counterclockwise, the cam body 32 is brought to turn counterclockwise, and vice versa. Hence, the actuating unit 3 is turnable between a first orientation in which the actuating region 322 is guarded against movement with the trigger body 24 toward the final-stage position so as to leave the ignition switch 22 to remain in the switch-off position, and a second orientation in which the actuating region 322 is engageable with the ignition switch 22 when moving with the trigger body 24 to the final-stage position, thereby displacing the ignition switch 22 to the switch-on position. The first biasing member 33 is disposed on the pivot body 31 to bias the pivot body 31 clockwise. The third biasing member 34 is disposed on and to bias the cam body 32 to permit the non-actuating region 323 to confront the ignition switch 22. By virtue of the first and third biasing members 33, 34, the actuating unit 3 is kept in the first orientation.

Figure 5:
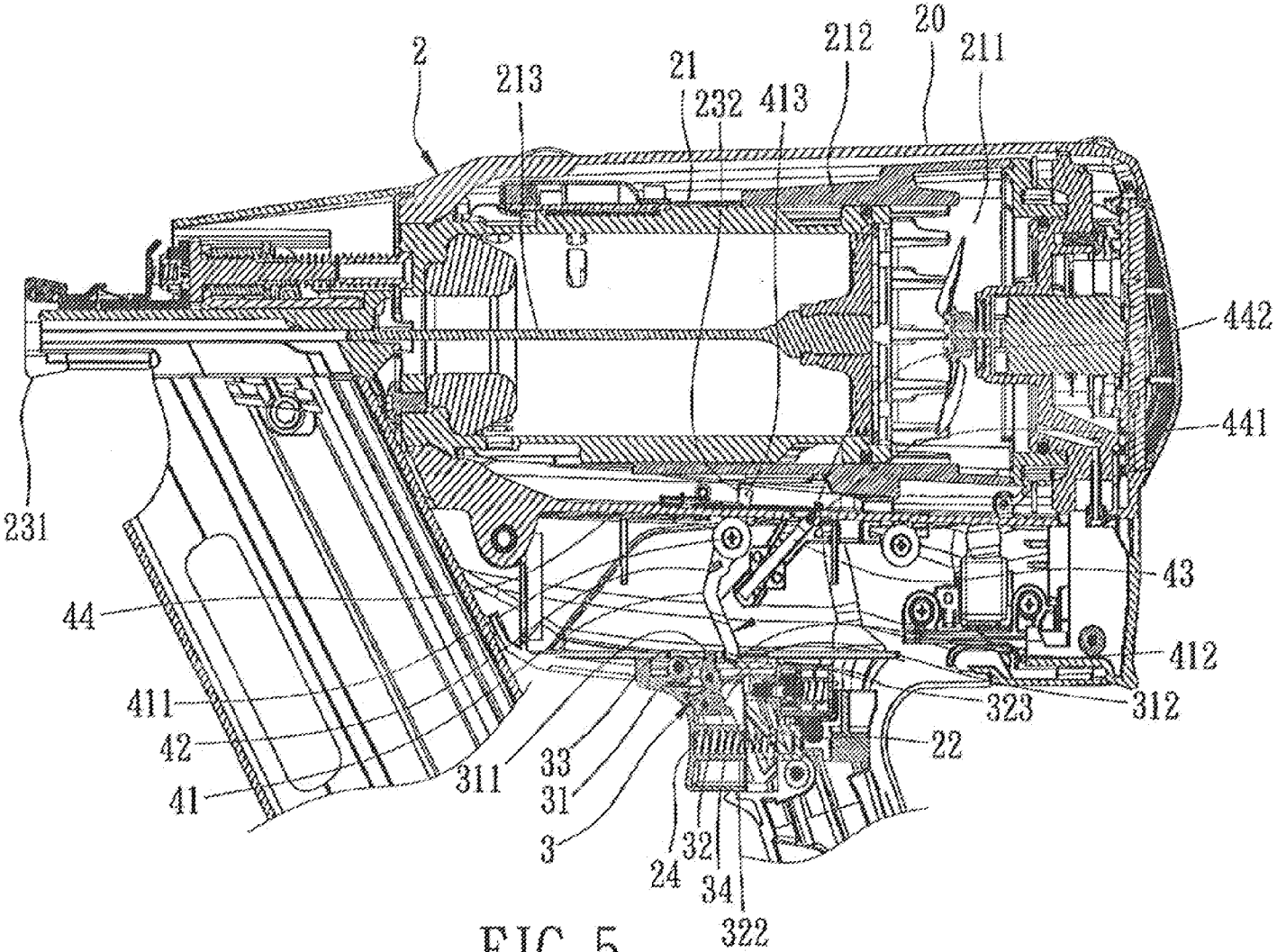
FIG. 5 is a fragmentary, sectional view illustrating the first embodiment with a press member pressed against a targeted surface and with the lever in a shifted position.

A lever 41 is disposed in the main chamber 201 to be turnable about a fulcrum axis 411, and has a power end 413 disposed rearwardly of the actuator 232, and a weight end 412 confronting the actuated region 311 of the pivot body 31 in the longitudinal direction so as to be movable between a non-shifted position, as shown in FIG. 4, where the weight end 412 is remote from the actuated region 311, and a shifted position, as shown in FIG. 5, where the weight end 412 is closer to the actuated region 311. A second biasing member 42 is disposed to bias the weight end 412 toward the non-shifted position. The fulcrum axis 411 is distant from the power end 413 by a length that is ½ of a length by that the fulcrum axis 411 is distant from the weight end 412.

Referring to FIGS. 3 and 4, when the combustion powered tool device of this embodiment is in a normal state and is not engaged with a targeted surface, the weight end 412 of the lever 41 is in the non-shifted position to be remote from the actuated region 311 of the pivot body 31, and the actuating unit 4 is in the first orientation, where the non-actuating region 323 of the cam body 32 confronts the ignition switch 22.

Referring to FIGS. 4 and 5, in use, when the push member 231 is pressed against the targeted surface to the pressed position, the actuator 232 is brought to push the power end 413 of the lever 41 so as to move the weight end 412 to the shifted position, where the weight end 412 is closer to the actuated region 311 of the pivot body 31, thereby placing the combustion powered tool device in a striking ready state. Meanwhile, the valve sleeve 212 is moved with the push member 231 to a combustion chamber-closing position so as to close the combustion chamber 211.

Figure 6:
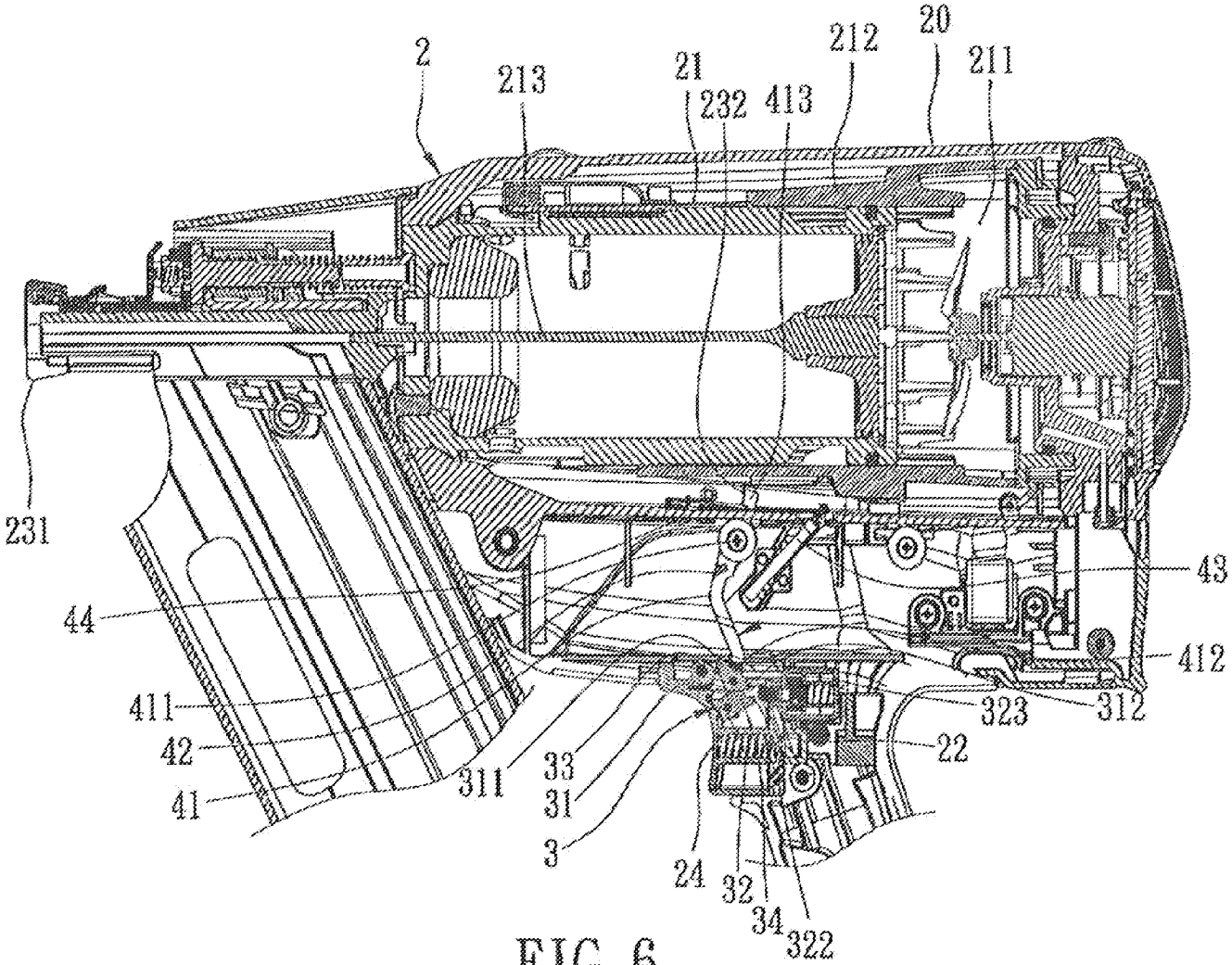
FIG. 6 is a fragmentary, sectional view illustrating the first embodiment with the lever in the shifted position and with a trigger body in an initial-stage position.

Referring to FIG. 6, next, when the trigger body 24 is pressed to the initial-stage position, the actuating unit 3 is moved with the trigger body 24 such that the actuated region 311 of the pivot body 31 is brought to abut against the weight end 412 of the lever 41 to turn the pivot body 31 counterclockwise. Meanwhile, the cam body 32 is turned by the pivot body 31 counterclockwise to displace the actuating unit 3 to the second orientation, where the actuating region 322 confronts the ignition switch 22.

Figure 7:
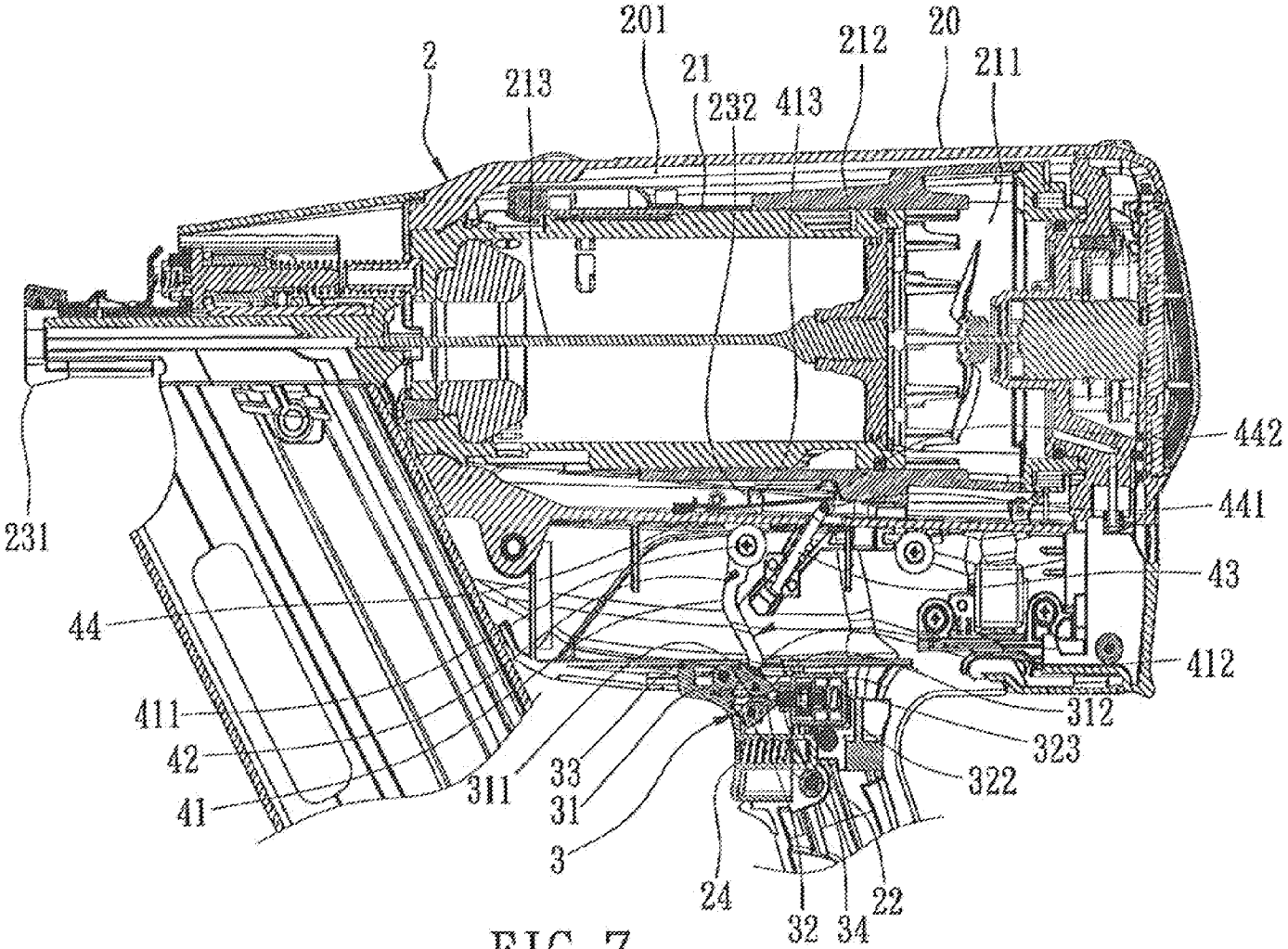
FIG. 7 is a fragmentary, sectional view illustrating the first embodiment with the lever in the shifted position and with the trigger body in a final-stage position.

Referring to FIG. 7, subsequently, when the trigger body 24 continues to be pressed to the final-stage position, the actuating region 322 is brought to push the ignition switch 22 to the switch-on position so as to ignite the combustion for initiation of the stroke movement of the piston-driver blade assembly 213 for striking a nail into the targeted surface.

Moreover, as shown in FIG. 7, a driving shaft 43 is disposed in the main chamber 201, and is actuated in response to triggering action of the trigger body 24 to elevate an anchoring end 442 of a leaf spring 44 which has an anchored end 441 connected to the driving shaft 43 to engage in and urge against the valve sleeve 212. Hence, during operation, an undesired premature forward movement of the valve sleeve 212 can be effectively delayed until when the trigger body 24 is released and returns to the untriggered position, thereby preventing adverse effect arisen from irregular bouncing-back action of the biasing member 233. Meanwhile, as a result of concurrently delayed opening of the combustion chamber 211, the driver blade may timely be withdrawn back into the cylinder 21.

Figure 8:
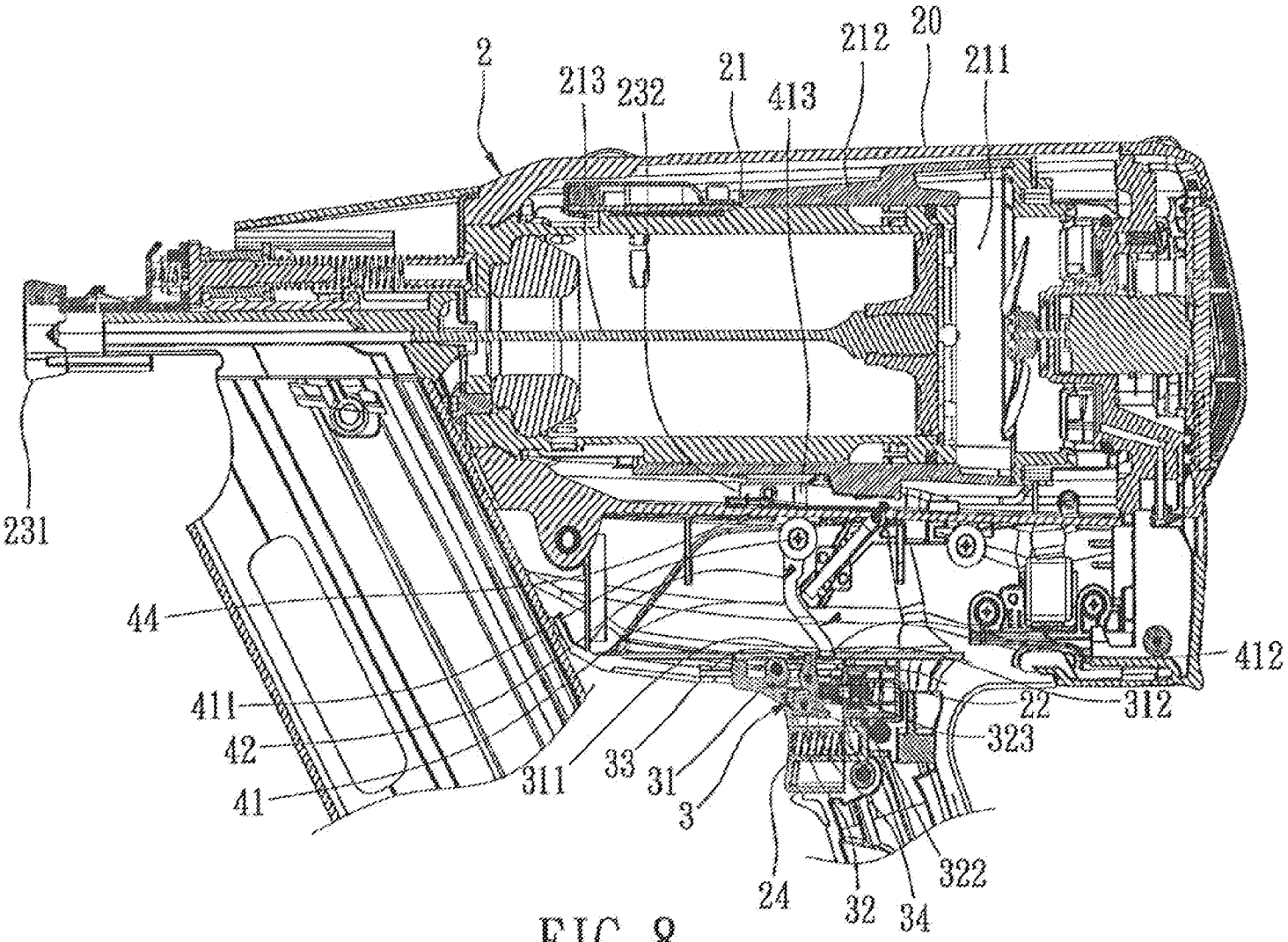
FIG. 8 is a fragmentary, sectional view illustrating the first embodiment with the trigger body is triggered before the press member is pressed against a targeted surface.
Figure 9:
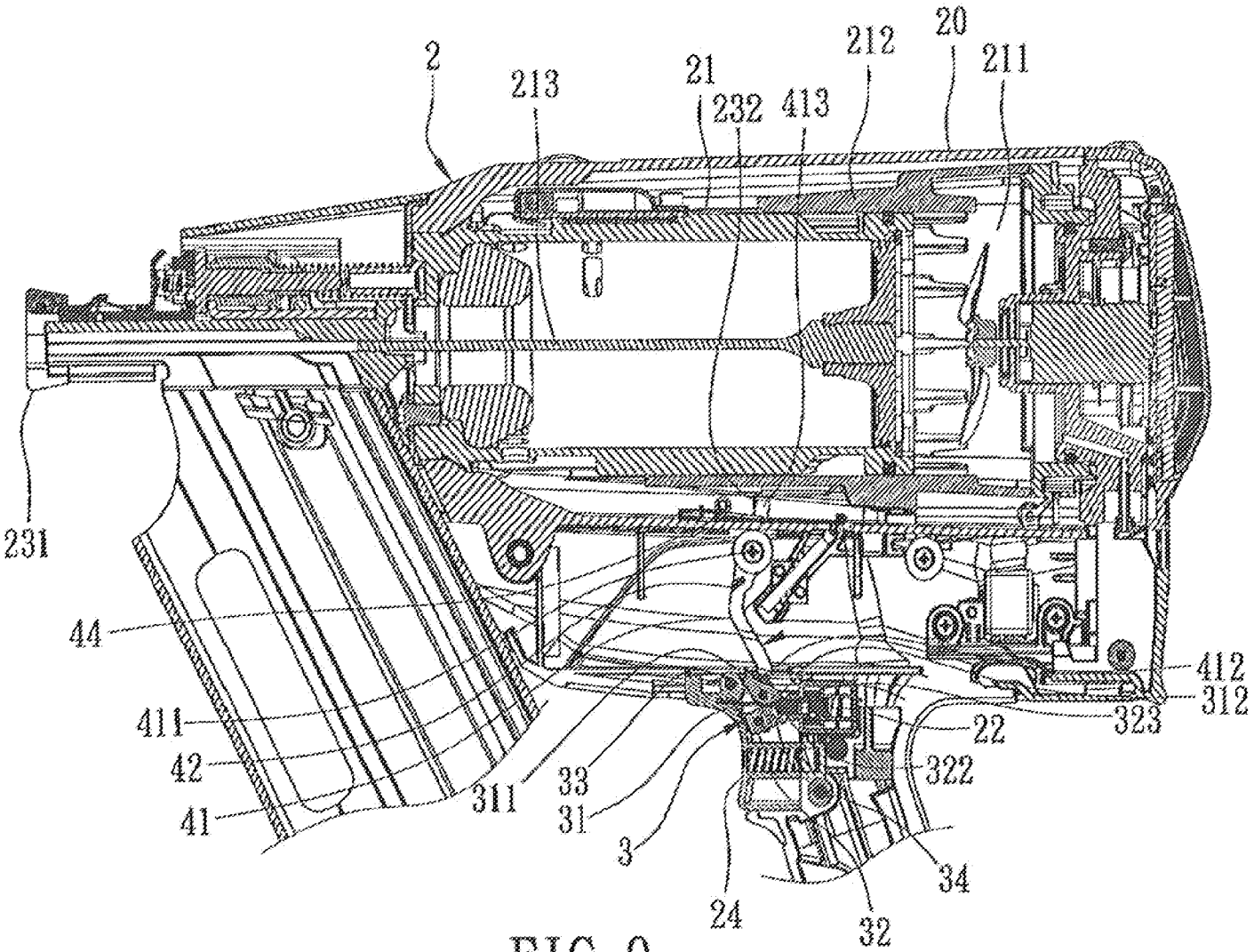
FIG. 9 is a fragmentary, sectional view illustrating the first embodiment with the press member being pressed against the targeted surface subsequent to FIG. 8.

Referring to FIG. 8, in the event that, before the push member 231 is pressed against a targeted surface, the user pulls the trigger body 24, the ignition switch 22 can remain in the switch-off position because the actuating unit 3 is kept in the first orientation. Next, referring to FIG. 9, in the event that while the push member 231 is pressed against the targeted surface, the counterclockwise turning of the pivot body 31 and the cam body 32 is however restrained by the ignition switch 22 from reaching an extent that is sufficient to move the actuating unit 3 to the second orientation. Hence, the ignition switch 22 remains in the switch-off position.

Figure 10:
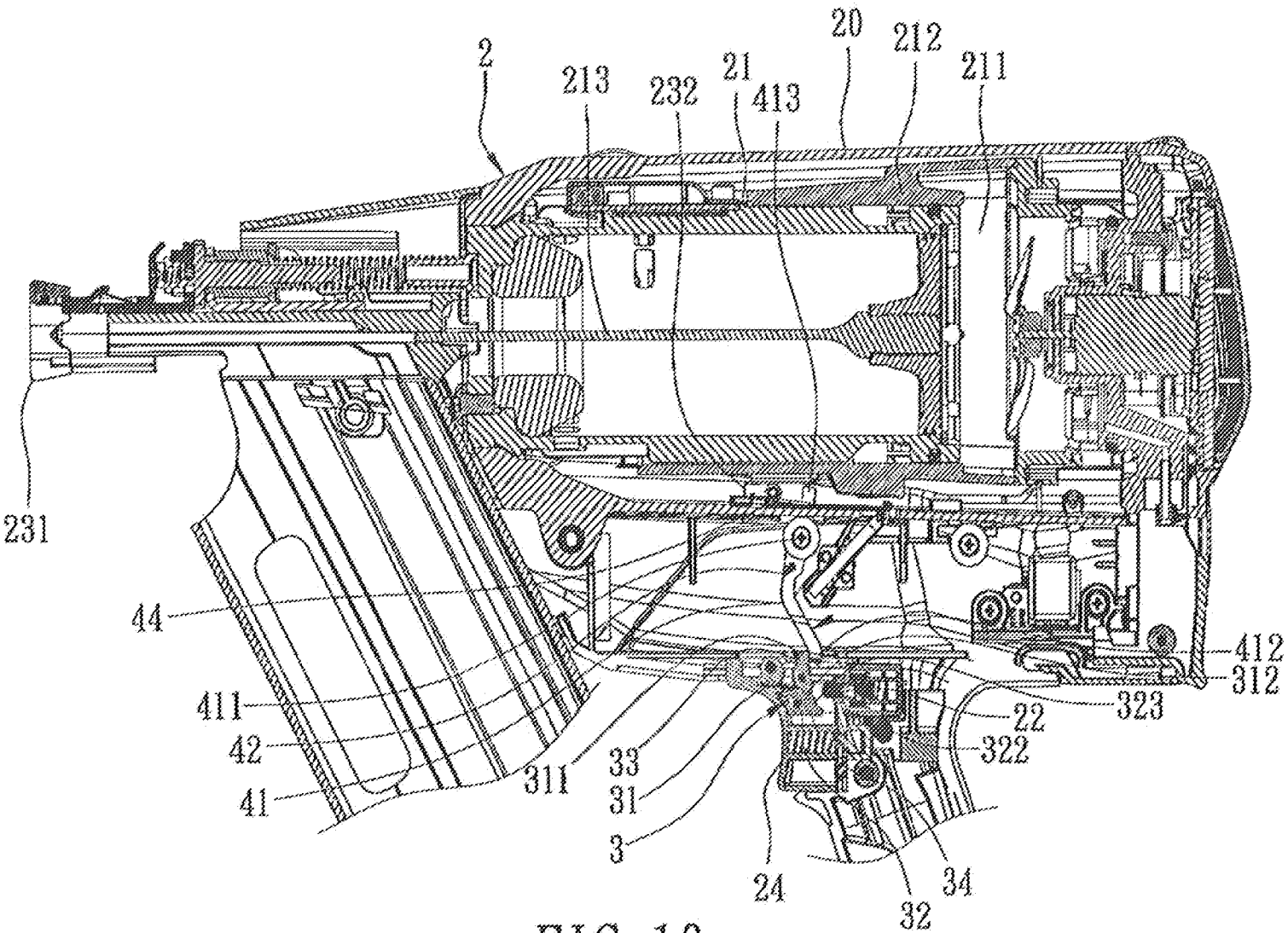
FIG. 10 is a fragmentary, sectional view illustrating the first embodiment with the press member removed from the targeted surface subsequent to FIG. 6.
Figure 11:
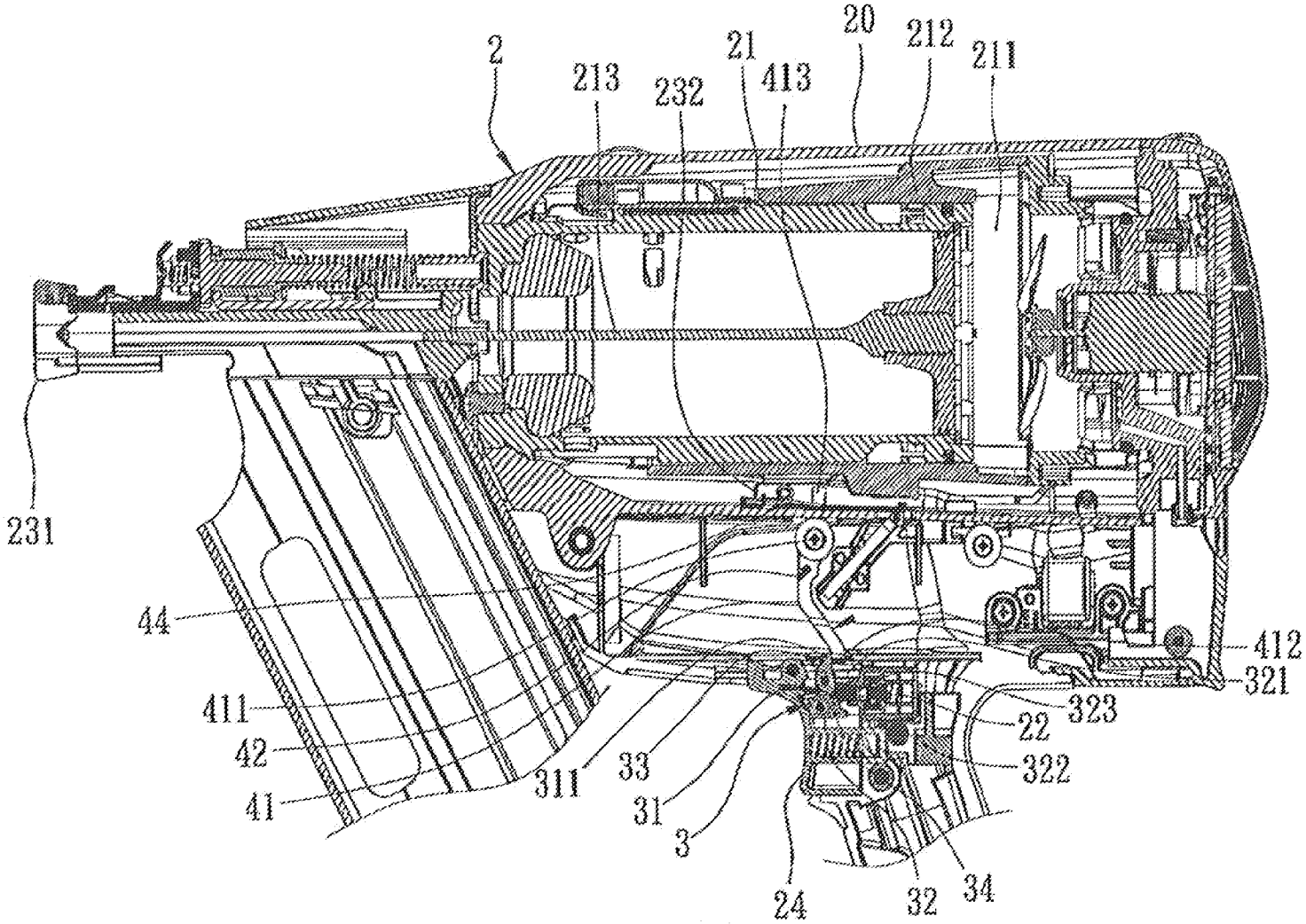
FIG. 11 is a fragmentary, sectional view illustrating the first embodiment with the trigger body moved to the final-stage position subsequent to FIG. 10.
Figure 12:
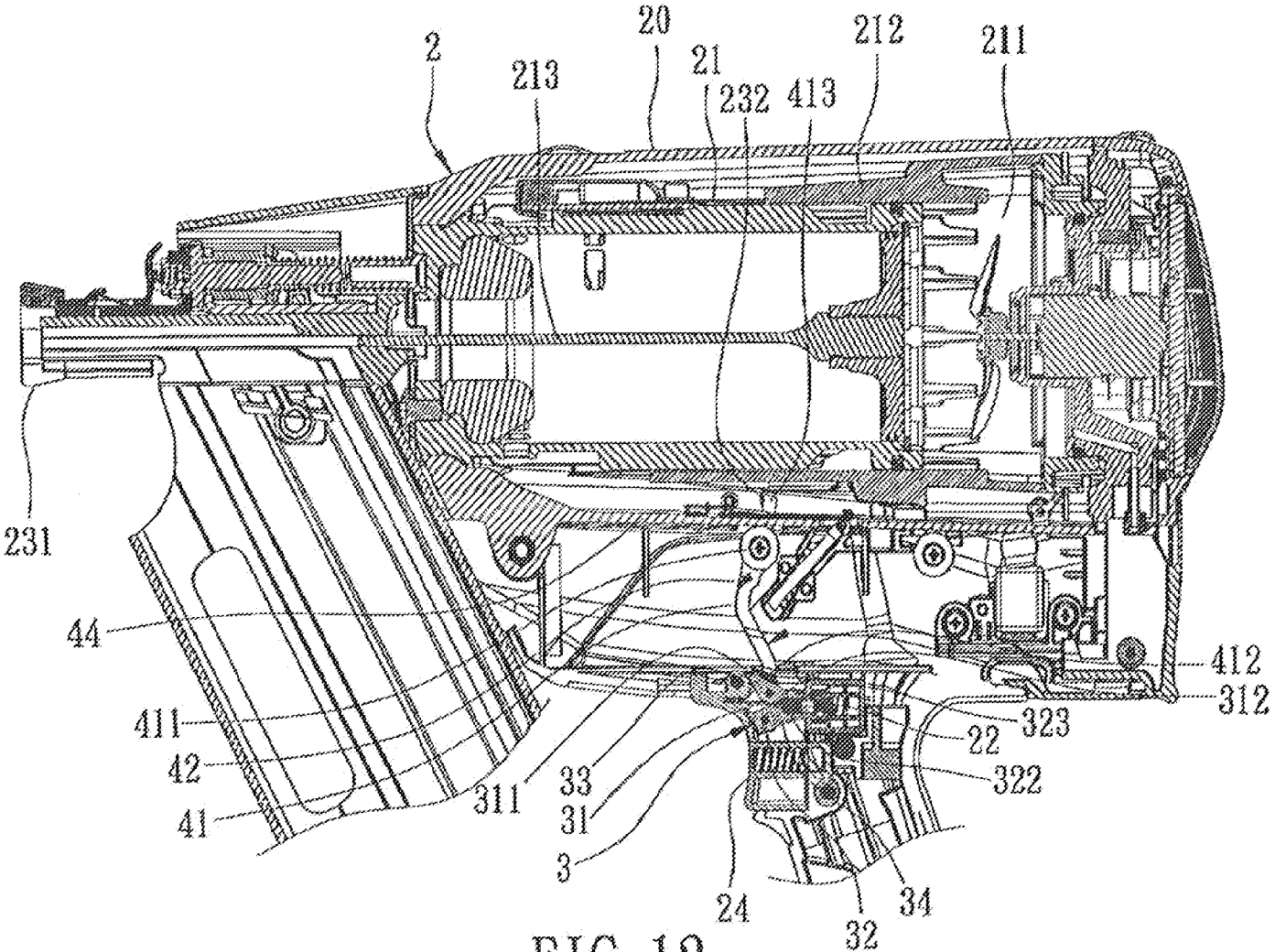
FIG. 12 is a fragmentary, sectional view illustrating the first embodiment with the push member pressed against the targeted surface subsequent to FIG. 11.

In the event that the push member 231 is displaced to be disengaged from the targeted surface while the trigger body 24 has yet be moved toward the final-stage position, i.e., the triggering action has been aborted, as shown in FIG. 6, the weight end 412 of the lever 41 is returned to the non-shifted position by the biasing action of the second biasing member 42 so as to be disengaged from the actuated region 311 of the pivot body 31. Consequently, referring to FIG. 10, the pivot body 31 and the cam body 32 are turned clockwise by the biasing action of the first and third biasing members 33, 34 and back to the first orientation. At this juncture, even when the user continues to pull the trigger body 24 to the final-stage position, as shown in FIG. 11, the ignition switch 22 remains in the switch-off position. Also, since the length between the fulcrum axis 411 and the weight end 412 is longer than the length between the fulcrum axis 411 and the power end 413, the weight end 412 can be disengaged from the actuated region 311 of the pivot body 31 immediately after the power end 413 is moved forwardly for safety purposes. Subsequent to FIG. 11, and as shown in FIG. 12, once the push member 231 is pressed against the targeted surface again to turn the pivot and cam bodies 31, 32 counterclockwise, the ignition switch 22 is engaged in a space between the pivot and cam bodies 31, 32 so as not to be switch on.

Figure 13:
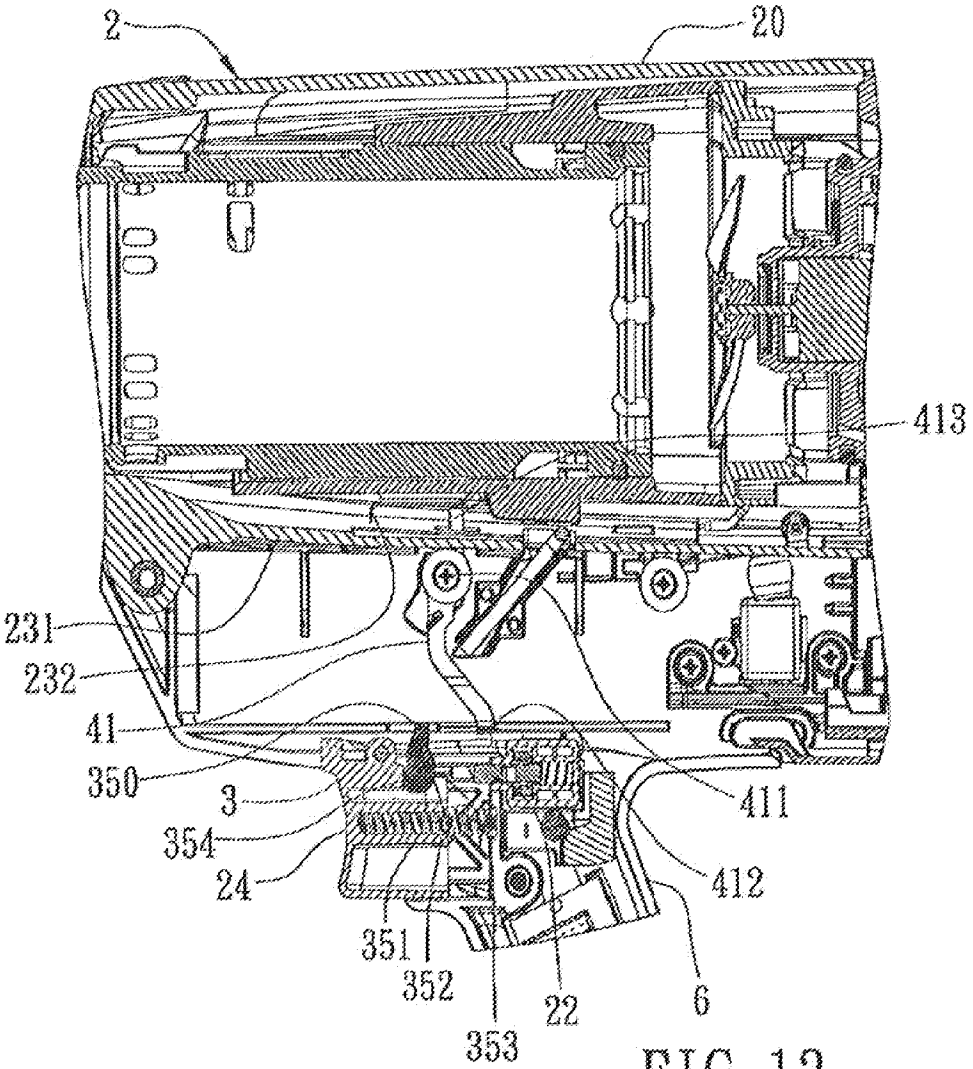
FIG. 13 is a fragmentary, sectional view of the second embodiment of a dual safety combustion powered tool device according to this invention.
Figure 14:
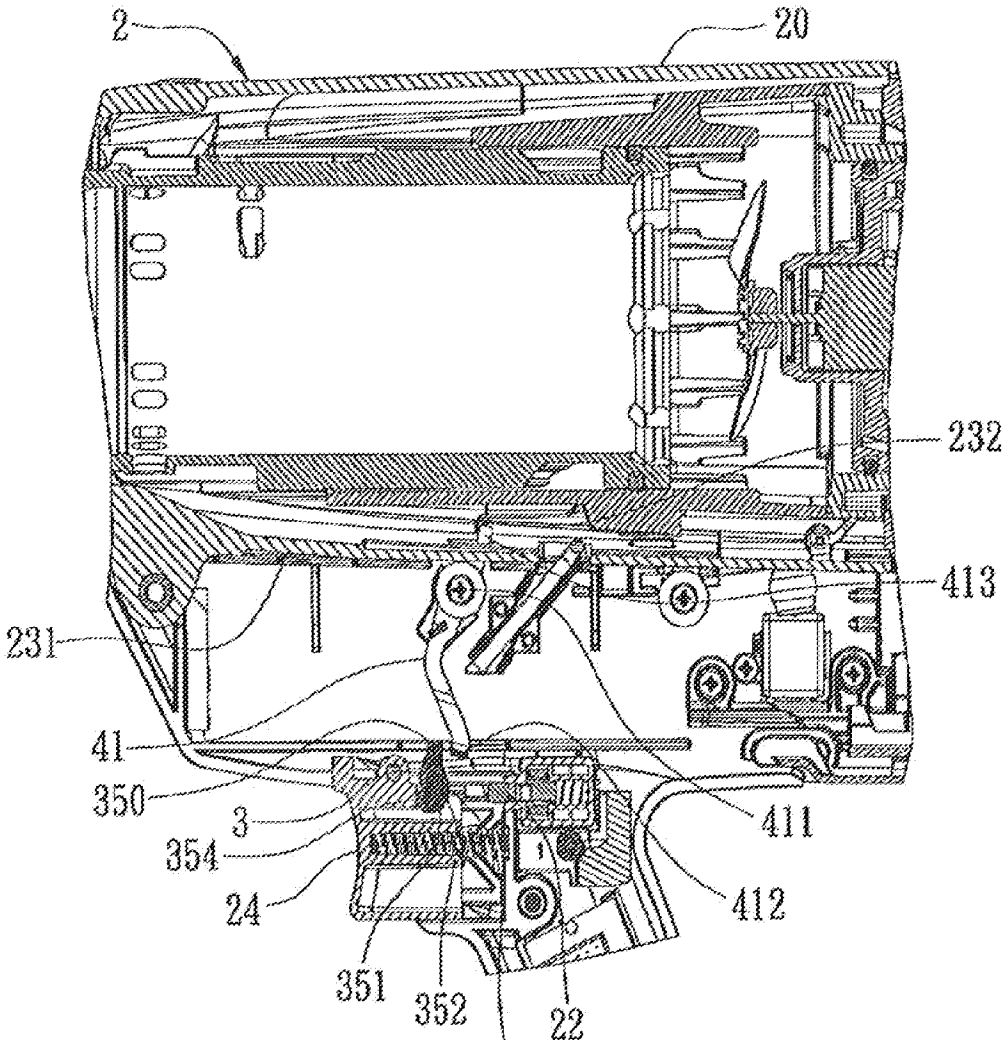
FIG. 14 is a fragmentary, sectional view illustrating the second embodiment with a press member pressed against a targeted surface to move a lever to a shifted position.
Figure 15:
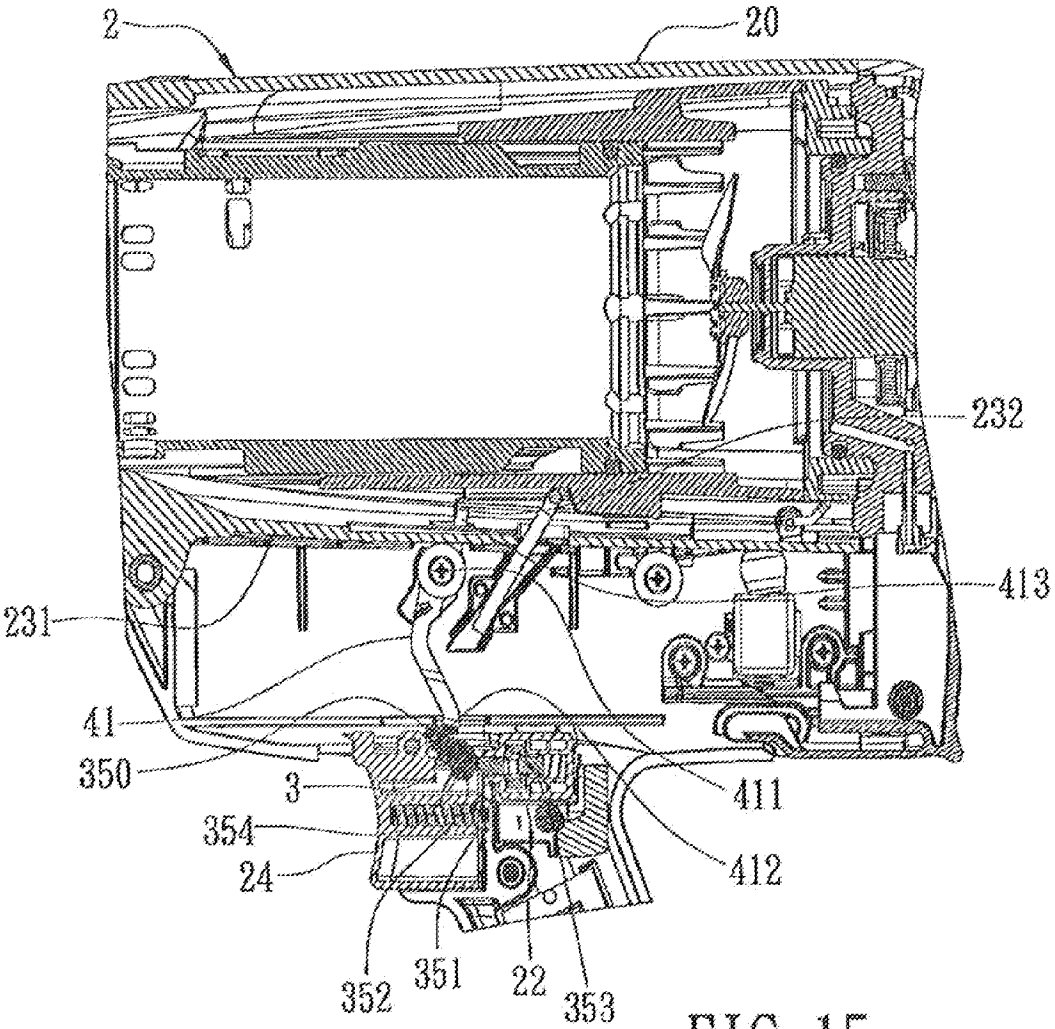
FIG. 15 is a fragmentary, sectional view illustrating the second embodiment with the lever in the shifted position and with a trigger body moved to a final-stage position.

Referring to FIG. 13, the second embodiment of a dual safety combustion powered tool device 2 according to this invention is similar to the first embodiment, except that the actuating unit 3 is in the form of a single-piece body, and has a pivot area pivotable mounted in the handgrip body 6 about a pivot axis 352, an actuated region 350 confronting the weight end 412 of the lever 41, an actuating region 351, a non-actuating region 353, and a pushed region 354 which are formed on a contour surface thereof and which are angularly displaced from each other about the pivot axis 352. The pushed region 354 is engaged and moved with the trigger body 24 and is opposite to the actuated region 350 relative to the pivot axis 352. As shown in FIGS. 14 and 15, after the weight end 412 of the lever 91 is moved to the shifted position as a result of pressing the push member 231 against a targeted surface so as to turn the actuating unit 3 to the second orientation, the actuating unit 3 can be moved with the trigger body 24 by pulling the trigger body 24 to the final-stage position so as to switch on the ignition switch 22.

Figure 16:
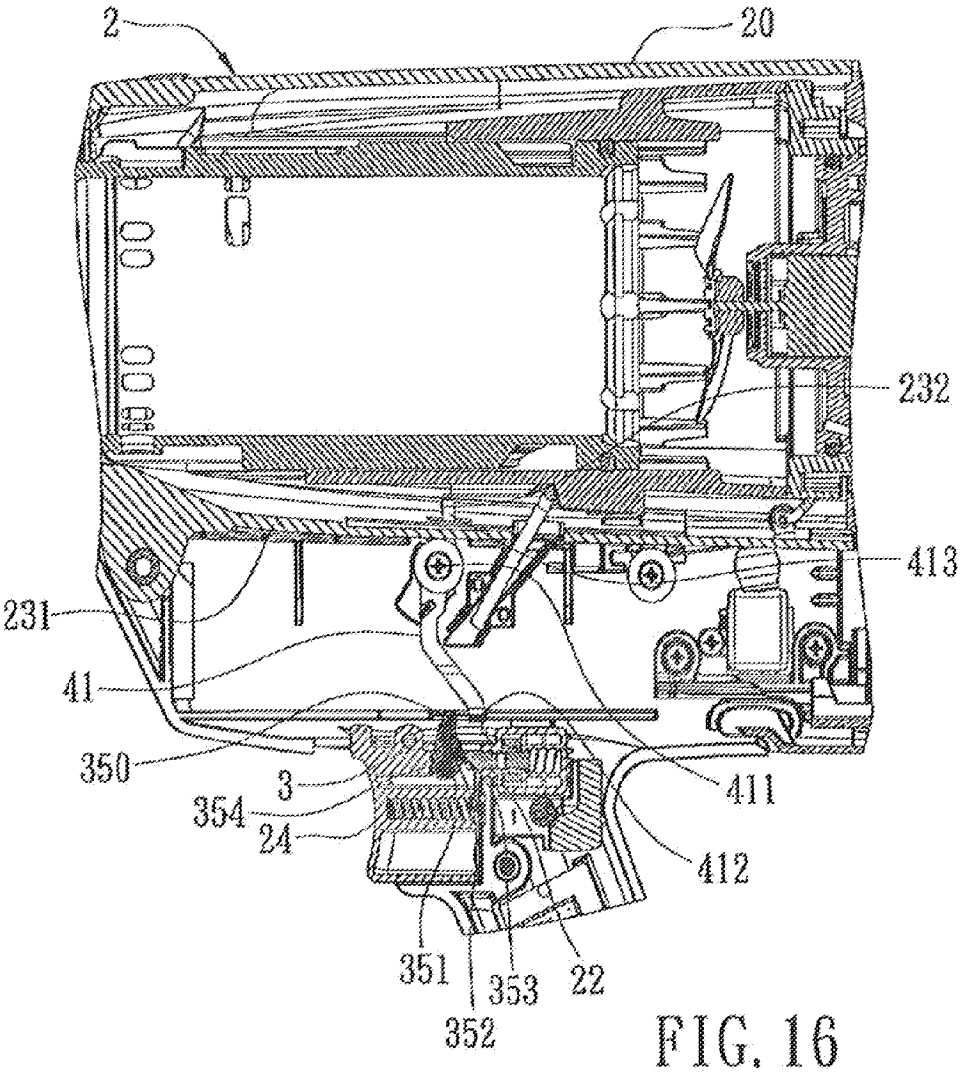
FIG. 16 is a fragmentary, sectional view illustrating the second embodiment with the trigger body being triggered before the press member is pressed against the targeted surface.

Referring to FIG. 16, once the trigger body 24 is pulled and the push member 231 is not pressed against a targeted surface, the actuating unit 3 is still in the first orientation, where the non-actuating region 353 confronts and engages the ignition switch 22, and the ignition switch 22 remains in the switch-off position. Hence, undesired firing of the combustion powered tool device 2 can be avoided.

With such construction of the dual safety combustion powered tool device 2 according to this invention, uncompleted triggering action of the trigger body 24 or wrong procedure order of the generation (pulling the trigger body 24 first, and then pressing the push member 231 against a targeted surface) cannot result in undesired switching on of the ignition switch 22. Therefore, usage of the device 2 is quite safe.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A dual safety combustion powered tool device comprising:

a housing body defining a main chamber which extends in a longitudinal direction to terminate at nose and head ends;

a handgrip body defining a subchamber which is adjacent to said main chamber;

an ignition switch mounted in and movable relative to said subchamber between a switch-off position and a switch-on position where said ignition switch is switched on to ignite a combustion for initiation of a stroke movement;

a trigger body disposed to be movable among an untriggered position, an initial-stage position, and a final-stage position;

an actuating unit which is disposed to move with said trigger body, and which has a pivot area that defines a pivot axis, an actuated region, and an actuating region that is opposite to said actuated region relative to said pivot area, said actuating unit being turnable about the pivot axis between a first orientation in which said actuating region is guarded against movement with said trigger body toward said final-stage position so as to leave said ignition switch to remain in the switch-off position, and a second orientation in which said actuating region is engageable with said ignition switch when moving with said trigger body to the final-stage position, thereby displacing said ignition switch to said switch-on position;

a first biasing member disposed to bias said actuating unit toward the first orientation;

a push member disposed forwardly of and movable to said nose end between a normal position, where said push member is remote from said head end, and a pressed position, where said push member is closer to said head end as a result of being pressed against a targeted surface;

a lever disposed in said main chamber to be turnable about a fulcrum axis, and having a power end and a weight end which confronts said actuated region in the longitudinal direction, and which is movable between a non-shifted position, where said weight end is remote from said actuated region, and a shifted position, where said weight end is closer to said actuated region;

a second biasing member disposed to bias said weight end toward the non-shifted position;

an actuator which is disposed forwardly from said power end, and which is coupled to move with said push member such that, when said push member is displaced to the pressed position, said actuator is brought to push said power end so as to move said weight end to the shifted position, and such that, when said actuating unit is moved with said trigger body to the final-stage position, said actuated region is brought to abut against said weight end to displace said actuating unit to the second orientation.

2. The dual safety combustion powered tool device as claimed in claim 1, wherein said actuating unit has a non-actuating region which is disposed between said actuated and actuating regions and which confronts said ignition switch when in the first orientation, said non-actuating region being angularly displaced from said actuating region, and configured to be remoter from said ignition switch than said actuating region such that, when moved with said trigger body toward the final-stage position, said non-actuating region is guarded against displacing said ignition switch to the switch-on position.

3. The dual safety combustion powered tool device as claimed in claim 2, wherein said actuating unit includes a pivot body which has said pivot area pivotally mounted in said subchamber about the pivot axis, and a cam body which is pivotally mounted in said subchamber about a cam axis parallel to the pivot axis, and which has a cam surface about the cam axis to serve as said actuating region and said non-actuating region, said pivot body being engaged with said cam body so as to angularly displace said cam body about the cam axis as a result of turning said pivot body about the pivot axis, said actuating region being distant from the cam axis by a longer length than the one by which said non-actuating region is distant from the cam axis.

4. The dual safety combustion powered tool device as claimed in claim 3, wherein said first biasing member is disposed on said pivot body, and further comprising a third biasing member disposed on and to bias said cam body to permit said non-actuating region to confront said ignition switch.

5. The dual safety combustion powered tool device as claimed in claim 2, wherein said actuating region and said non-actuating region are angularly displaced from each other about the pivot axis.

6. The dual safety combustion powered tool device as claimed in claim 1, wherein the fulcrum axis is distant from said weight end by a longer length than the one by which the fulcrum axis is distant from said power end.

7. The dual safety combustion powered tool device as claimed in claim 1, further comprising:

a cylinder disposed in said main chamber;

a valve sleeve mounted on and movable relative to said cylinder so as to open and close a combustion chamber;

a leaf spring having an anchored end and an anchoring end which confronts said valve sleeve; and a driving shaft disposed in said main chamber, and connected to said anchored end of said leaf spring, said driving shaft being actuated in response to triggering action of said trigger body to elevate said anchoring end of said leaf spring to engage in and urge against said valve sleeve.

* * * * *